United States Patent [19]

Bockstruck

[11] 4,454,674

[45] Jun. 19, 1984

[54] SHOTSHELL CHAMBER

[75] Inventor: Herman N. Bockstruck, Alton, Ill.

[73] Assignee: Olin Corporation, Stamford, Conn.

[21] Appl. No.: 449,345

[22] Filed: Dec. 13, 1982

Related U.S. Application Data

[63] Continuation-in-part of Ser. No. 339,238, Jan. 13, 1982.

[51] Int. Cl.[3] ..... F41C 21/12

[52] U.S. Cl. ..... 42/76 R; 102/448

[58] Field of Search ..... 42/76 R; 102/448, 464, 102/467, 469, 447; 89/14 R

[56] References Cited

U.S. PATENT DOCUMENTS 2,831,287 4/1958 Maillard ..... 42/76 R 3,407,526 10/1968 Freed ..... 42/59

OTHER PUBLICATIONS

Winchester/Remington 8 Gauge Industrial Shells (per photo). Logan, Cartridges, 1948, pp. 46 and 47, "Caliber 41."

*Primary Examiner*—Charles T. Jordan

*Assistant Examiner*—Ted L. Parr

*Attorney, Agent, or Firm*—Bruce E. Burdick

[57] ABSTRACT

A method of using standard commercial shotshells in a non-standard chamber is disclosed. The non-standard chamber is at least ½ mm larger in diameter than the shell of a continuous axial length of at least 3 mm immediately forward of the rim breeching bevel. By conventional standards this would appear to be unsafe yet the method has been determined to be quite safe and allows commercial shotshells to be used in a chamber designed for combat shotshells which will not fit into standard commercial shotgun chambers of similar gauge size.

11 Claims, 5 Drawing Figures

SHOTSHELL CHAMBER

Figure 1:
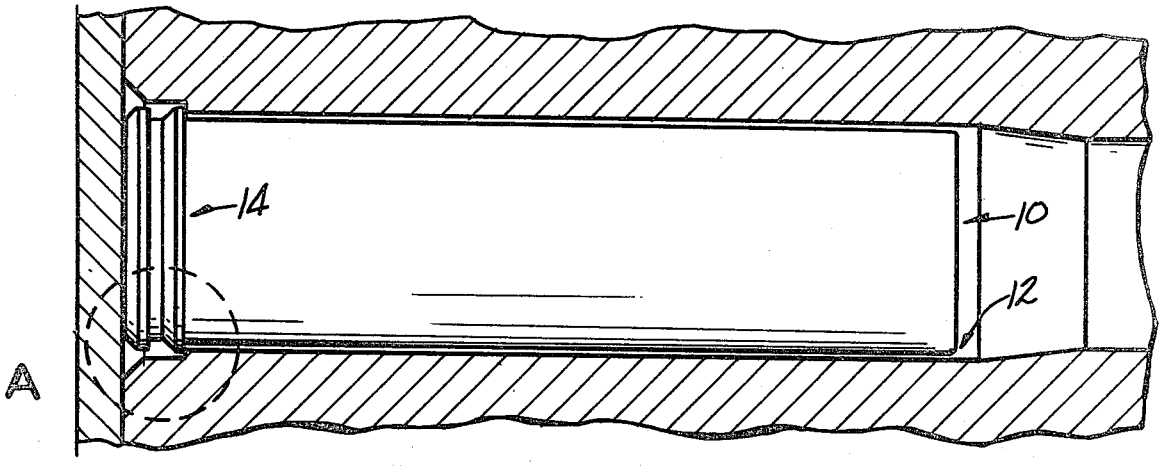

This application is a continuation-in-part of copending application Ser. No. 339,238, filed Jan. 13, 1982.

This invention relates to the relationship between a commercial shotgun cartridge and a shotgun chamber and to the novel shotgun chamber itself.

There has arisen an increased need for a shotgun and shotgun cartridge which is adapted for combat situations involving the need for rapid fire and multiple projectiles. The presently available rifles and shotguns are not entirely suitable for this application due to limited range in the case of shotguns and insufficient number of projectiles in the case of rifles. As a result of this need, there have been attempts to design and develop shotshells and shotguns having greatly increased firing pressures in order to achieve increased range. For safety purposes it is highly desirable that such high-powered shotshells be incapable of use with conventionally chambered sporting shotguns since such shotguns may not have sufficient strength to contain the pressures developed by such combat shotshells during firing. However, there is also a need for economic reasons to provide for use of commercial shotgun cartridges in a combat shotgun during routine practices and emergency situations. For example, it would be desirable to use standard commercial shotshells for target practice and training purposes and to switch to the higher power combat shotshells in combat situations. Also, it is desirable that combat personnel have the ability to use commercial shotshells in a combat shotgun in combat situations where supplies of combat shotshells run low due to interruption of supply lines or other reasons.

The applicable industry standards for shotgun chamber design are those set by SAAMI (Sporting Arms and Ammunition Manufacturers' Institute). These SAAMI standards are considered inviolate by the industry since a firearm found to have caused injury which firearm is in violation of the SAAMI specifications is almost certain to be considered an unacceptable product liability risk. In fact, the SAAMI standards were set up to protect the industry by inferring that those products within the SAAMI specs are safe by industry standards.

The present invention solves the need for a method of firing rimmed commercial shotshells in a breech loading shotgun with a barrel having a shotshell chamber at its breech and the chamber having a rim breeching bevel at the breech face, which method comprises the steps of (a) placing said commercial shot shell in a shotgun chamber of the same gauge size, said chamber having a recess at least ½ mm larger in diameter than said shell over a continuous axial length of at least 3 mm immediately forward of said rim breeching bevel; and (b) firing said commercial shotshell in said chamber without endangering the shooter and without preventing extraction of the fired shotshell. In order to accomplish this, the invention provides in a breech loading shotgun with a chamber at the breech end of the barrel intended to be used with 12 gauge commercial shotshells of the rimmed type, a chamber having an enlarged portion with a minimum diameter of at least 21 mm extending for an axial distance of at least 3 mm forward from the rim breeching bevel.

Figure 2:
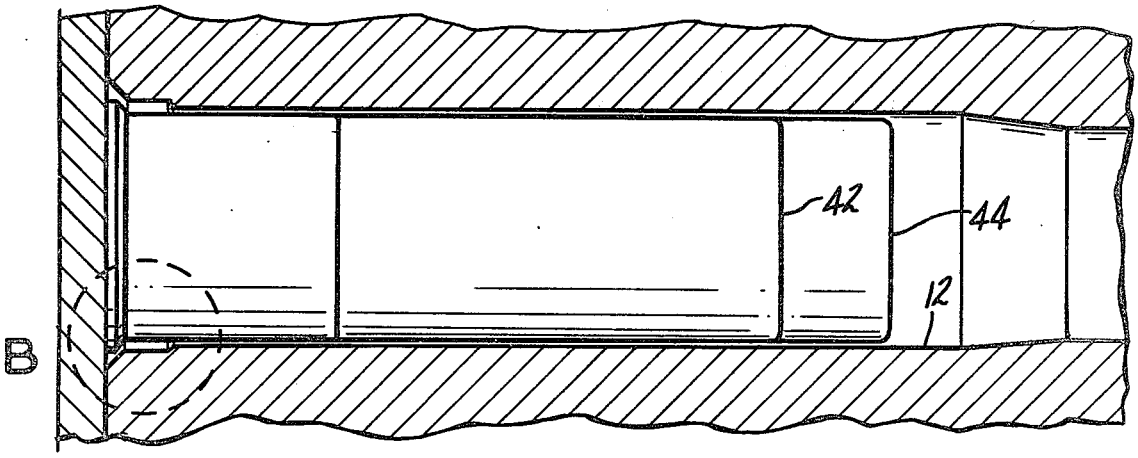
Figure 3:
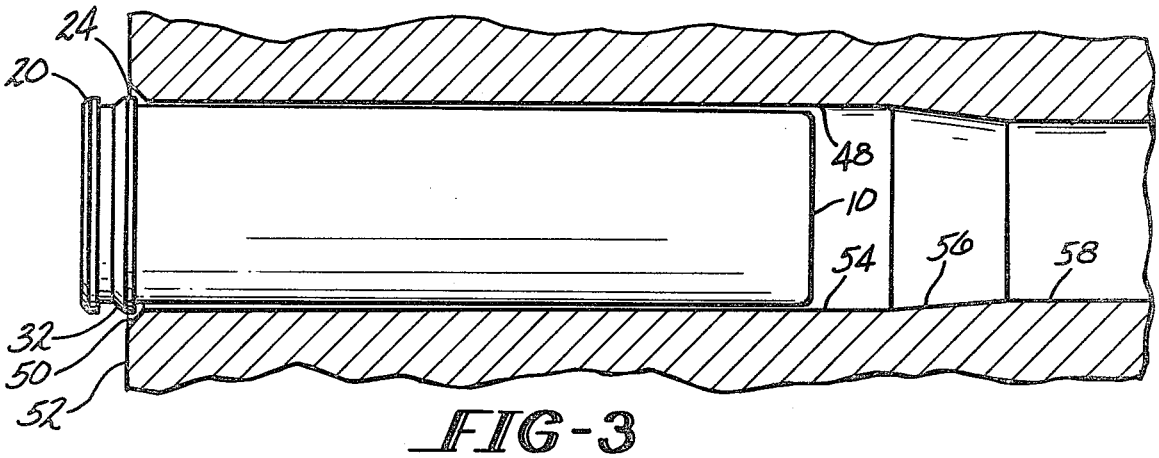
Figure 1A:
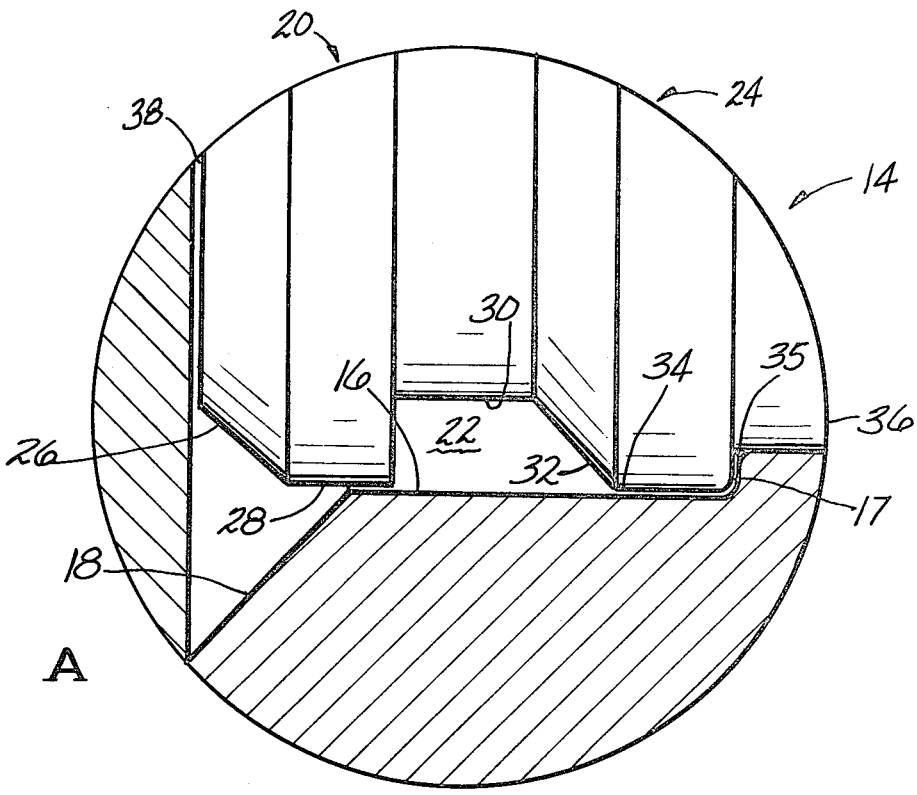
Figure 2A:
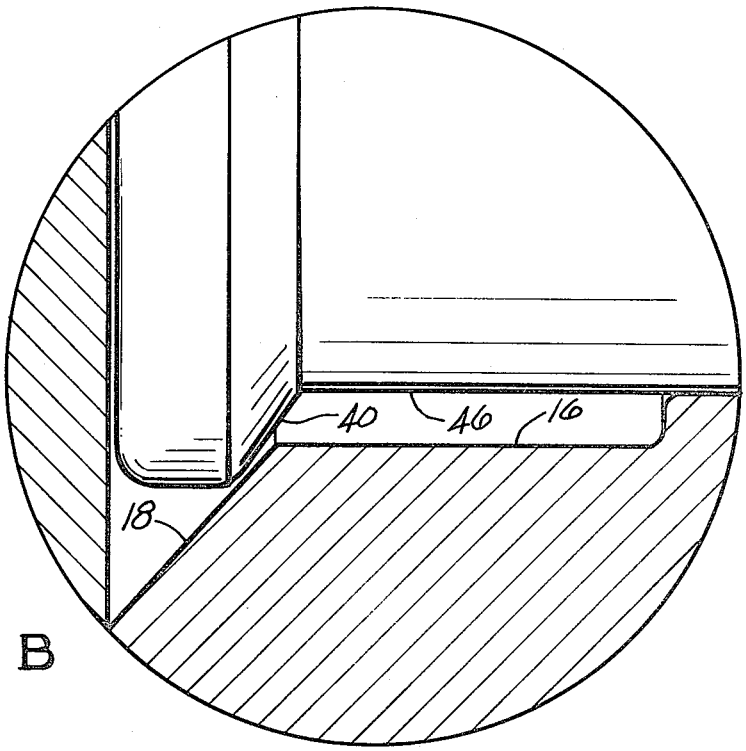

The invention will be better understood by reference to the attached drawings in which:

FIG. 1 is a cross-sectional view along the barrel axis of a combat shotgun with a combat shotgun shell chambered therein;

FIG. 1-A which is a close-up of portion A of FIG. 1 to show the enlarged portion of the chamber adapted to receive the double head rim and head recess of the combat shotgun shell;

FIG. 2 is a cross-sectional view along the barrel axis of a combat shotgun showing a chambered commercial shotshell cartridge;

FIG. 2-A which is a close-up of portion B of FIG. 2 showing the location of the base rim of a commercial shotshell in the combat shotgun; and FIG. 3 which is a cross-sectional view along the barrel axis of a commercial shotgun with a combat shotshell partially chambered showing the inability to fully chamber the combat shotshell due to the double head rim.

Referring to FIG. 1, combat shotshell 10 is shown in the chamber 12 of a combat shotgun especially adapted to receive shotshell 10. It will be seen that shotshell 10 includes head portion 14 which is adapted to fit within a counterbored recess in chamber 12.

Referring to FIG. 1-A it is seen that shotshell 10 has head portion 10 disposed within a counterbored recess 16 of chamber 12. Recess 16 is of greater inside diameter than the inside diameter of the remainder of the chamber of the shotgun but is of less diameter than a beveled portion (breeching bevel) 18 adjacent to the barrel breech face of the shotgun. Recess 16 is, in fact, in excess of the maximum chamber under SAAMI specifications. Recess 16 ends forwardly at a seating ledge 17 and from ledge 17 forward is of conventional chamber diameter. Head portion 14 includes a base rim 20, an extraction recess 22 and a second belt rim 24 which lies immediately to the right of recess 22, that is, toward the mouth of the shotshell. Rim 20 has a beveled section 26 facing away from the mouth end of the shotshell and right cylindrical section 28 immediately toward the mouth end from the beveled section 26. Recess 22 has a right cylindrical wall 30 coaxial with the axis of the shotshell but of a smaller external diameter than the diameter of the remainder of the shotshell. This results in a flat annular radial surface on the side of the base rim towards the mouth of the shotshell to allow for use of greater extraction forces than in prior shotshells. Second belt rim 24 includes a beveled section 32 facing away from the mouth end of the shotshell and has a right cylindrical section 34 immediately toward the mouth end from the beveled section 32 and a flat annular seating shoulder 35 facing toward the mouth end and joining rim 24 to tube portion 36. Shoulder 35 is adapted to seat on a conforming seating ledge 17 of chamber recess 16. Shotshell 10 has a tube portion 36 which is slightly tapered from second rim 24 to the mouth end of the shotshell and which extends from rim 24 to the mouth end. The base end 38 of shotshell 10 is of an outside diameter less than the outside diameter of tube portion 36 at the mouth end of the shotshell 10. Head portion 14 and tube portion 36 are preferably a single integral piece and preferably both consist essentially of cartridge brass to allow for use of loads having higher firing pressures which might damage plastic or paper shells typical of most commercial shotshells. The combat shotshell 10 is preferably a 12 gauge shotshell of at least a 3 inch uncrimped length. This makes the combat shotgun compatible with both commercial 12 gauge shotshells and the combat shotshell 10.

FIGS. 2 and 2-A show the appearance of chamber 12 when either a 2¾ inch or 3 inch 12 gauge commercial shotshell cartridge 42 or 44 is chambered in chamber 12. It will be seen that shotshell 44 chambers easily within chamber 12 since the bevel section 18 of chamber 12 adjacent the breech end of the barrel of the combat gun receives the base rim 40 of the 3 inch commercial shotshell. Note that for a commercial shotshell the seating surface is no longer seating ledge 17 but is breeching bevel 18. It is most surprising and unusual to have two separate seating surfaces in a single chamber and use only one at a time selectively. However, it will be noted that the side wall 46 of the head portion of shotshell 42 or 44 does not lie tightly against the chamber wall in chamber recess 16 since chamber recess 16 is of greater internal diameter than the remainder of the chamber 12 in order to allow rims 20 and 24 to be received within chamber recess 16. Although this spacing between the inside wall of chamber recess 16 and the side wall 46 of a commercial shotshell has been previously considered to be unsafe and undesirable, actual testing of commercial shotshells in a chamber having a chamber recess 16 has demonstrated that this spacing is safe and that side wall 46 remains intact even though it is allowed to expand more than usual.

For example, for 12 gauge shells the seating surface 17 can be located about 5½ mm forward axially from the breech face (See 52 in FIG. 3) and recess 16 can have a diameter of about 21½ mm, the maximum SAAMI 12 gauge commercial shell head diameter is 20.549 mm in the area of such a shell which would lie in recess 16.

FIG. 3 shows shotshell 10 partially chambered in the chamber 48 of a conventional 12 gauge sporting shotgun. Chamber 48 conventionally has a beveled section 50 adjacent the breech end 52 of the barrel of the commercial shotgun and has a tapered cylindrical portion 54 extending approximately the length of the shotshell expected to be chambered in chamber 48, typically 2¾ inch or 3 inch. Immediately forward of tapered cylindrical wall 54 is a more sharply tapered cylindrical wall 56 which tapers from wall 54 to the barrel bore 58 of the shotgun. It will be seen that when shotshell 10 is attempted to be chambered in chamber 48 second belt rim 24 cannot pass inside of tapered wall 54. Instead, rim 24 is restrained by beveled section 50 and prevented from passing therethrough. This results in base rim 20 being held in a position spaced rearward of the breech end of the barrel by some predetermined distance which is sufficient to prevent the conventional breech bolt from assuming a firing position behind rim 20, thus disabling the commercial shotgun and preventing firing of the combat shotshell in such a commercial shotgun.

From the above disclosure it will be seen that a chamber is provided which accepts both a combat shotshell and a commercial shotshell of equivalent gauge even though the combat shotshell cannot be operably chambered in a commercial shotgun. It will be appreciated that minor modifications to the shotgun chamber can be made without departing from the scope of the invention. It will also be appreciated that while 12 gauge is referenced, the invention is also applicable to other shotgun cartridge-chamber systems.

I claim:

1. A method of firing rimmed commercial shotshells in a breech loading shotgun with a barrel having a shotshell chamber at its breech and the chamber having a rim breeching bevel at the breech face, which method comprises the steps of:

(a) placing said commercial shotshell in a shotgun chamber of the same gauge size, said chamber having a recess at least ½ mm larger but not more than 1½ mm larger in diameter than said shell over a continuous axial length of at least 3 mm immediately forward of said rim breeching bevel; and (b) firing said commercial shotshell in said chamber without endangering the shooter and without preventing extraction of the shotshell when fired.

2. The method of claim 1 wherein said shotshell is a commercial 12 gauge shell and said minimum chamber recess diameter is at least 21 mm.

3. The method of claim 2 wherein the portion of said chamber having a minimum chamber diameter of at least 21 mm extends for at least 3 mm forward from said rim breeching bevel.

4. The method of claim 1 wherein said shotshell is a commercial 12 gauge shell and said minimum chamber recess diameter is at least 21.5 mm.

5. In a breech loading shotgun with a chamber at the breech of the barrel intended to be used with commercial shotshells of the rimmed type, a chamber having an enlarged portion with a diameter in said portion of within the range of from 1 mm to 3 mm larger than a standard commercial shotshell head, measured immediately forward of such shotshell's base rim, of the same gauge size as said chamber, said portion extending for an axial distance of at least 3 mm forward from the rim breeching bevel.

6. In the shotgun of claim 5 wherein said enlarged portion has a minimum diameter of at least 21.5 mm.

7. In the shotgun of claim 6 wherein said enlarged portion extends for an axial distance of at least 4 mm forward from the rim breeching bevel.

8. In the shotgun of claim 5 wherein said chamber has both a breeching bevel adjacent the breech of said barrel and a shotshell seating surface located at least 3 mm forward of the rim breeching bevel.

9. In the shotgun of claim 8 in combination with a belted shotshell seated on said seating surface, said shotshell having a belt which prevents chambering of said belted shotshell in a commercial type shotgun chamber.

10. In the shotgun of claim 8, wherein said seating surface is an annular shoulder.

11. In the shotgun of claim 10, wherein said shoulder is rounded at its inner and outer edges.

* * * * *